US011717745B2

(12) United States Patent
Greenawalt et al.

(10) Patent No.: US 11,717,745 B2
(45) **Date of Patent: *Aug. 8, 2023**

(54) TIER-ON-TIER MULTIPLE LEVEL JIGSAW PUZZLE

(71) Applicants: Thomas Greenawalt, Palm Harbor, FL (US); Jean Greenawalt, Palm Harbor, FL (US)

(72) Inventors: Thomas Greenawalt, Palm Harbor, FL (US); Jean Greenawalt, Palm Harbor, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/525,000

(22) Filed: Nov. 12, 2021

(65) Prior Publication Data

US 2022/0072415 A1 Mar. 10, 2022

Related U.S. Application Data

(63) Continuation-in-part of application No. 16/993,874, filed on Aug. 14, 2020, now Pat. No. 11,198,056.

(51) Int. Cl.
*A63F 9/12* (2006.01)

(52) U.S. Cl.
CPC .... *A63F 9/1208* (2013.01); *A63F 2009/1232* (2013.01)

(58) Field of Classification Search
CPC ..... A63F 9/1208; A63F 2009/1232; A63F 2003/0022; A63F 2009/1077; A63F 2009/1083; A63F 2009/1088
See application file for complete search history.

(56) References Cited

U.S. PATENT DOCUMENTS

| | | | | | |
|---|---|---|---|---|---|
| D243,783 | S | * | 3/1977 | Kleinman | 273/157 R |
| 4,257,606 | A | * | 3/1981 | Launzel | A63F 9/1288 273/157 R |
| 4,469,331 | A | * | 9/1984 | Rinker | A63F 9/12 273/157 R |
| 5,178,391 | A | * | 1/1993 | Schoen | A63F 9/12 273/153 R |
| 5,362,054 | A | * | 11/1994 | Ashemimry | A63F 9/12 273/157 R |
| 5,735,521 | A | * | 4/1998 | Klimpert | A63F 9/10 273/157 R |

(Continued)

FOREIGN PATENT DOCUMENTS

| | | | | |
|---|---|---|---|---|
| DE | 20219320 U1 | * | 3/2003 | A63F 9/10 |
| DE | 202008013809 U1 | * | 12/2009 | A63F 9/10 |

(Continued)

*Primary Examiner* — Steven B Wong
(74) *Attorney, Agent, or Firm* — Robert Varkonyi; Prometheus IP PLLC

(57) ABSTRACT

A tier-on-tier multiple level jigsaw puzzle comprised of varying thickness and irregular interlocking pieces which, when assembled, form an image with visible surfaces in relief relative to the tabular surface. The puzzle is formed of a lower, base puzzle and an upper puzzle, which when combined have variable distinct surfaces and variable thickness with planar and/or textured surfaces to result in a raised relief 3D effect. The specific mix of individual pieces exhibiting variable thicknesses & distinct surfaces enhances enjoyment by adding strategic elements to puzzle assembly and optimizes the quality of the image.

19 Claims, 12 Drawing Sheets

(56) References Cited

U.S. PATENT DOCUMENTS

| | | | | | |
|---|---|---|---|---|---|
| 5,791,647 | A * | 8/1998 | Reiling | A63F 9/10 | 273/157 R |
| 6,427,926 | B1 * | 8/2002 | Lai | A63H 18/02 | 104/53 |
| 8,074,989 | B1 * | 12/2011 | Bassett | A63F 9/0001 | 273/157 R |
| 8,113,518 | B2 * | 2/2012 | Rosen | A63F 9/12 | 273/157 R |
| 11,198,056 | B2 * | 12/2021 | Greenawalt | A63F 9/1208 | |
| 2004/0228989 | A1 * | 11/2004 | Abramek | B44C 1/28 | 428/33 |
| 2005/0179199 | A1 * | 8/2005 | Gaussen | A63F 9/12 | 273/157 R |
| 2013/0154188 | A1 * | 6/2013 | Burrows | A63F 9/10 | 273/157 R |

FOREIGN PATENT DOCUMENTS

| | | | | | |
|---|---|---|---|---|---|
| DE | 202017001674 | U1 * | 7/2017 | | |
| GB | 2290161 | A * | 12/1995 | A63F 9/10 | |
| GB | 2326602 | A * | 12/1998 | A63F 9/12 | |

* cited by examiner

TIER-ON-TIER MULTIPLE LEVEL JIGSAW PUZZLE

CROSS REFERENCE TO RELATED APPLICATIONS

This application is a continuation-in-part of U.S. Non-provisional application Ser. No. 16/993,874, entitled: "Multiple Level Jigsaw Puzzle", filed Aug. 14, 2020, which claims priority to U.S. Provisional Application 62/886,401, entitled: "Multiple Level Jigsaw Puzzle", filed Aug. 14, 2019, herein incorporated by reference in its entirety.

FIELD OF INVENTION

This invention relates to a jigsaw puzzle having different levels. Specifically, the invention provides jigsaw puzzles with multiple levels comprised of tiers designed to connect to the adjacent pieces using knobs and holes, whereby the multiple levels provide a new element in the strategic assembly of the jigsaw puzzle and enhance the impact of the three dimensional-like image.

BACKGROUND OF THE INVENTION

Jigsaw puzzles which are assembled by matching a number of interlocking puzzle pieces to form a two-dimensional pictorial illustration on the surface of the puzzle are well-known. Two-dimensional jigsaw puzzles are typically comprised of interlocking puzzle pieces which are one level thick and form a single level when the puzzle is assembled. Traditionally, puzzles were solved by sorting/grouping puzzle pieces by edge pieces, color or pattern, and piece shape (knobs & holes). Increasing the difficulty of these puzzles is accomplished by increasing the number of puzzle pieces. While this does increase the difficulty, it does not alter the strategy but solely increases the time necessary to complete the puzzle.

Solutions for making jigsaw puzzles more challenging and visually interesting are important to the consumer as jigsaw puzzles, and something new in the product line, are in great demand. Two-dimensional jigsaw puzzles have many benefits including the improvement of problem solving/strategic thinking, short-term memory, visual & spatial reasoning, creativity, meditation & stress-relief, and learning ability. In addition, jigsaw puzzles can be designed to appeal to all ages, encourage social interaction or solitaire play. They also accommodate a wide range of difficulty levels that appeal to experts and those with special needs such as those on the autism spectrum or Dementia/Alzheimer's patients.

Three-dimensional images on jigsaw puzzles have created issues with the puzzle cost, deviations from familiar puzzle assembly and with the consistency and quality of the image. The image is either raised too drastically or not enough, not an image on a planar-based surface but a constructed object such as a building, or visually manipulated image (lenticular) on the piece thus negatively affecting the strategic assembly experience.

For example, Launzel (U.S. Pat. No. 4,257,606) provides for a jigsaw puzzle formed of puzzle pieces having varying height between a background section and object, with side shapes and surface contours to form an image elevated from the background. The assembled pieces generate an image having two levels. However, Launzel does not have adequate three-dimensional imagery, as the single elevation of the object does not provide for a well-defined projection of the object image. Furthermore, Launzel does not provide information about the breakdown of pieces into one-base level, one-elevated level, or two levels, and therefore does not provide information relating to the enhancement of the image and assembly strategy of the puzzle.

Rinker (U.S. Pat. No. 4,469,331) provides for a jigsaw puzzle formed on single level and multi-level pieces that are joined to preferably form up to three different levels. The puzzle pieces have knobs and notches or holes that are designed to fit pieces having the same height level, i.e. the third level notches/holes interact with the projections on third level of the neighboring piece. The upper levels of the puzzle are smaller than those of the lower levels, with the edges either contours, beveled, sloped, or having another shape. The puzzle pieces are designed such that lower levels must be assembled followed by higher levels, or levels assembled concurrently, as higher levels cannot be matched to lower levels. However, the puzzle is solved similarly to traditional puzzles, where each puzzle level must be solved independent of the others due to the height-specific jigsaw knobs and holes. Like Launzel, Rinker lacks information about the breakdown of pieces into one-base level, one-elevated level, or two levels, and therefore does not provide information relating to the enhancement of the image and assembly strategy of the puzzle.

As such, there is a need in the market for novel puzzles that alter and enhance the puzzle assembly strategy and quality of the three-dimensional image.

SUMMARY OF THE INVENTION

The inventive multiple level puzzle is composed of two separate puzzles, wherein a second puzzle is formed within the boundaries of a first puzzle, and builds upon the shapes and contours of the first puzzle to form a three-dimensional, multiple level jigsaw puzzle.

The multiple level puzzle is formed of a plurality of single tier puzzle pieces, and at least one multiple tier puzzle piece. The three-dimensional, tier-on-tier multiple level jigsaw puzzles of the present invention provide images with multiple raised sections while maintaining the classic jigsaw puzzle manufacturing processes. The strategy of assembling jigsaw puzzles is greatly dependent on the ability to sort and group the individual pieces. The typical order of sorting/grouping puzzle pieces is: border pieces, color or pattern, piece shapes (knobs & holes), and special or high contrast features. The inventive puzzle, with puzzle piece classifications, modifies the puzzle assembly strategy, due to height considerations and the breakdown of puzzle piece types by height, changes in tier elevation, number of separate levels and other factors. Thus, the multiple level jigsaw puzzles add new considerations to the sorting and grouping strategies. The inventive pieces can be sorted by thickness, changes in tier elevation, contoured relief surfaces, and the number of distinct surfaces. These multi-surface pieces are assembled to create the contoured edges using raised surfaces within the puzzle. The tier-on-tier multiple level jigsaw puzzle comprises a base puzzle and an upper puzzle.

The base puzzle is formed of a plurality of puzzle pieces making a base puzzle. The base puzzle has a base puzzle face and base puzzle upper puzzle interface, with the base puzzle face having an image adapted to interact with an upper puzzle to form a tiered or three-dimensional image. The base puzzle also includes base puzzle upper puzzle interface formed of printed facts pertaining to the tiered or three-dimensional image of the puzzle, a color, a lip bordering the base puzzle upper puzzle interface, a pattern, a message, or textured material adapted to engage a bottom face of the upper puzzle, or a recreation of an image on the upper puzzle. The printed facts can be a series of printed facts about the subject image disposed on a white background, a black background, a grey background, a solid-colored background, or a shaded background. The base puzzle upper puzzle interface can be a color, such as a white coloring, a black coloring, a grey coloring, a solid-colored coloring, or a shaded coloring. The base puzzle upper puzzle interface can be a pattern, such as hidden image designed to complement the puzzle object, a pattern that forms a hidden image, such as a color gradient, geometrical shapes, abstract images, and stereograms (autostereograms). The base puzzle upper puzzle interface alternative is a message, such as an inspirational message. Alternatively, the base puzzle upper puzzle interface is a textured material adapted to engage a bottom face of the upper puzzle. Examples of the textured material include ribbing or waffling imprinted or molded in the base puzzle upper puzzle interface face, smocking in the base puzzle upper puzzle interface face, fixing velour or velvet or felt in the base puzzle upper puzzle interface face, fixing sand or grit in the base puzzle upper puzzle interface face, embedding or laminating smocking, velour, velvet, or felt in the base puzzle upper puzzle interface face. Alternatively, the base puzzle upper puzzle interface face includes a recreation of an image on the upper puzzle. The recreation can be a black-and-white image, a faded image, i.e. whereby the colors are washed out, or full-color image. The base puzzle upper puzzle interface can be a section bordered by a lip. The lip can boarder any of the aforementioned base puzzle upper puzzle interface face options, such as printed facts, the colored background, a pattern, or textured material.

The plurality of single tier puzzle pieces includes at least a base tier, having a top face, a bottom face, and a minimum of three irregular edges disposed between the top face and the bottom face. A plurality of pieces optionally have four edges that generally forms a rectangle with a hole or knob on each edge. Irregular surfaces qualify as a knob or hole when they interlock with the complimentary hole or knob on an adjacent piece. The puzzle pieces have knobs and holes that interconnect for the entire thickness of the connecting puzzle pieces. Optionally, the base tier of the plurality of single tier puzzle pieces has a thickness of about 1.6 mm. Non-limiting examples of the thicknesses include 1.5 mm, 1.55 mm, 1.6 mm, 1.65 mm, or 1.7 mm.

Optionally, the base puzzle has one or more multiple tier puzzle pieces, whereby the multiple tier puzzle pieces include one or more elevated tiers are disposed on the top face of the base tier. The puzzle pieces include at least one knob or hole disposed on at least one irregular edge, wherein the knob or hole is complementary to an adjacent puzzle piece and interlocks with a complimentary hole or knob. The base tier has a thickness as described in the previous paragraph. The elevated tiers each have a thickness between 1.2 mm and 1.9 mm. Non-limiting examples of the thicknesses include 1.1 mm, 1.2 mm, 1.3 mm, 1.4 mm, 1.5 mm, 1.55 mm, 1.6 mm, 1.65, 1.7 mm, 1.75 mm, 1.8 mm, 1.85 mm, 1.90 mm, 1.95 mm, and 2.0 mm. A plurality of pieces optionally have four edges that generally forms a rectangle with a hole or knob on each edge. Irregular surfaces qualify as a knob or hole when they interlock with the complimentary hole or knob on an adjacent piece. The puzzle pieces have knobs and holes that interconnect for the entire thickness of the connecting puzzle pieces.

The upper puzzle is formed of a plurality of puzzle pieces making the upper puzzle. The upper puzzle has a tiered or three-dimensional image that interacts with the base puzzle. The upper puzzle is formed of a plurality of single tier upper puzzle pieces or multiple tier puzzle pieces. The single tier upper puzzle pieces are formed of a first tier, having a top face, a bottom face, and at least three irregular edges disposed between the top face and the bottom face, and at least one knob or hole disposed on at least one irregular edge of the at least a base tier, wherein the knob or hole is complementary to and interlocking with an adjacent puzzle piece. The at least one multiple tier upper puzzle piece is formed of a first tier, wherein the first tier has a top face, a bottom face, and at least three irregular edges disposed between the top face and the bottom face, at least a first elevated tier disposed on the top face of the first tier, wherein the first elevated tier has a first tier top face and a first tier bottom face, and is at a first height and at least one knob or hole disposed on at least one irregular edge of the first tier and first elevated tier, wherein the knob or hole is complementary to and interlocking with an adjacent puzzle piece. In some variations, the base puzzle interacts with the upper puzzle by means of one or more linking puzzle pieces. The linking puzzle pieces include two-tier puzzle pieces and three-tier puzzle pieces. Where linking puzzle pieces are used, the linking puzzle pieces fit over single-tier puzzle pieces and interact with single-tier puzzle pieces and two tier puzzle pieces on the base puzzle, upper puzzle, or both, thereby locking the base puzzle and upper puzzle together. Alternatively, the linking puzzle pieces fit over two tier puzzle pieces on the base puzzle and interact with adjacent single tier and two tier puzzle pieces on the base puzzle and single tier puzzle pieces on the upper puzzle. The tiers of the single tier upper puzzle pieces or each tier of the multiple tier upper puzzle piece each have a thickness between 1.2 mm and 1.9 mm. Non-limiting examples of the thicknesses include 1.1 mm, 1.2 mm, 1.3 mm, 1.4 mm, 1.5 mm, 1.55 mm, 1.6 mm, 1.65, 1.7 mm, 1.75 mm, 1.8 mm, 1.85 mm, 1.90 mm, 1.95 mm, and 2.0 mm. The puzzle pieces have knobs and holes that interconnect for the entire thickness of the connecting puzzle pieces. Optionally, the upper puzzle pieces comprise a minimum of 25% of the total number of plurality of puzzle pieces.

In some variations, the exposed surfaces of the base puzzle and the upper puzzle include at least one contour textured surface disposed on the top face of the uppermost tier, i.e. the upper face of a single tier puzzle piece or the upper elevated tier of a multiple tier puzzle piece. The contoured textured surface is designed to mimic a subject object. Optionally, the top face of at least one of the plurality of single tier puzzle pieces has a textured, or a contoured and textured surface. The texture is, without limiting the scope of the invention, smocking, velour, velvet, felt, artificial fur, flocking, plush, glitter, foil, vinyl leather-texture material, vinyl wood-texture material, sand, or other materials.

The tier-on-tier multiple level jigsaw puzzle pieces include border pieces that frame the perimeter of the completed multiple level puzzle. Corner pieces optionally have four irregular edges with a hole or knob on two of the edges that are complementary and interlocking with adjacent pieces. Border edge pieces optionally have four irregular edges with a hole or knob on three of the edges that interlock with adjacent pieces.

The inventive multiple level jigsaw puzzle pieces optionally have a larger average surface area than the standard jigsaw puzzle. The larger pieces allow for a greater number of pieces to have multiple levels while being tactilely and visually more appealing to a wider audience. In certain embodiments, the puzzle pieces further have an average surface area or average planar area of at least 0.8 square inches to 3.25 square inches. Non-limiting examples include 0.8 sq.in., 0.85 sq.in., 0.9 sq.in., 1.0 sq.in., 1.10 sq.in., 1.15 sq.in., 1.20 sq.in., 1.25 sq.in., 1.30 sq.in., 1.35 sq.in., 1.40 sq.in., 1.45 sq.in., 1.50 sq.in., 1.55 sq.in., 1.60 sq.in., 1.65 sq.in., 1.70 sq.in., 1.75 sq.in., 1.80 sq.in., 1.85 sq.in., 1.90 sq.in., 1.95 sq.in., 2.00 sq.in., 2.05 sq.in., 2.10 sq.in., 2.15 sq.in., 2.2 sq.in., 2.25 sq.in., 2.3 sq.in., 2.4 sq.in., 2.5 sq.in., 2.6 sq.in., 2.7 sq.in., 2.8 sq.in., 2.9 sq.in., 3.0 sq.in., 3.1 sq.in., 3.15 sq.in., 3.2 sq.in., or 3.25 sq.in. The puzzle pieces of the multiple level puzzle are optionally made of cardboard, wood, paperboard, chipboard, or plastic. Optional plastics include high impact polystyrene, acrylonitrile butadiene styrene, acrylic, cellulose acetate, cyclic olefin copolymer, ethylene-vinyl acetate, ethylene vinyl alcohol, polyvinylfluoride, polyvinylidene fluoride, polytetrafluoroethylene, polychlorotrifluoroethylene, fluorinated ethylene-propylene, perfluoroalkoxy polymer, polyethylenechlorotrifluoroethylene, polyethylenetetrafluoroethylene, perfluoropolyether, acrylic/PVC polymer, aromatic polyester polymers, polyoxymethylene, polyamide, polyamide-imide, polyaryletherketone, polybutadiene, polybutylene, polybutylene terephthalate, polycaprolactone, polychlorotrifluoroethylene, polyethylene terephthalate, polycyclohexylene dimethylene terephthalate, polycarbonate, polyhydroxyalkanoate, polyketone, polyester, polyethylene, polyetheretherketone, polyetherimide, polyethersulfone, chlorinated polyethylene, polyimide, polylactic acid, polymethylpentene, polyphenylene oxide, polyphenylene sulfide, polyphthalamide, polypropylene, polystyrene, polysulfone, polytrimethylene terephthalate, polyurethane, polyvinyl acetate, polyvinyl chloride, polyvinylidene chloride, or styrene-acrylonitrile.

The puzzle pieces of the multiple level jigsaw puzzle can be classified in various ways. The classifications enable the optimization of both the image quality and the enjoyment of the puzzle assembly. A first classification is based on the number of visible surface tiers disposed on the puzzle piece. For example, the single level puzzle pieces can be identified as single level but multiple tier pieces. The single level pieces can be further identified as visible tier 1 pieces, visible tier 2 pieces, or visible tier 3 pieces. Multiple level pieces have two or three visible tiers. For example, a puzzle piece with tier 2 and tier 3 visible top surfaces is identified as a visible tier 2 and a visible tier 3. The puzzle pieces are optionally formed such that at least 35% of the puzzle pieces are fall into a visible tier 1 classification, and at least 15% fall into a visible tier 2 classification, when the pieces are viewed compared to the total amounts. In some variations, at least 15% of the pieces fall into a visible tier 3 classification. For example, without being limited in scope, the visible tier 1 puzzle pieces can comprise 35%, 36%, 37%, 38%, 39%, 40%, 41%, 42%, 43%, 44%, 44.5%, 45%, 47.5%, or 50%. Similarly, visible tier 2 optionally comprise, without limiting the scope of the invention, 15%, 16%, 17%, 18%, 19%, 20%, 21%, 22%, 22.5%, 25%, 27.5%, or 30%. Visible tier 3 can comprise, without being limited in scope, 15%, 15.5%, 16%, 16.5%, 17%, 17.5%, 18%, 19%, 20%, 21%, 22%, 23%, 24%, 25%, 26%, 27%, 27.5%, or 30%.

The second classification of puzzle pieces is by piece type. The piece type classification includes flat or one level pieces, bi-level pieces, and tri-level pieces. For example, a bi-level piece may include a tier 1 and a tier 3 on the same piece and is identified as a 1+3 puzzle piece. Similarly, a tri-level piece may have a tier 1, a tier 2 and a tier 3 on the same piece and is identified as a 1+2+3 puzzle piece. Alternatively, the pieces are classified based upon completion of the puzzle, with the connected puzzle pieces result in the following piece classifications. For example, a bi-level piece having 3 tiers could have a 1+3 visible tier, which can form a puzzle section having a bi-level (1+3 or 2+4)) or tri-level puzzle section (1±3+4). Optionally, the flat pieces (one level or single level pieces) in the piece type classification can comprise at least 20% of the puzzle pieces. Nonlimiting examples include 20%, 21%, 22%, 24%, 25%, 26%, 27% 28%, 29%, 30%, 34%, 35%, 36%, 37%, 38%, 39%, 40%, 41%, 42%, 43%, 44%, 45%, 46%, 47%, 48%, 49%, 50%, 51%, 52%, 53%, 54%, 55%, 57.5%, 60%, or 65%. The bi-level pieces optionally comprise at least 35% of the puzzle pieces. Nonlimiting examples include 35%, 36%, 37%, 38%, 39%, 40%, 41%, 42%, 43%, 44%, 45%, 46%, 47%, 48%, 49%, 50%, 51%, 52%, 53%, 54%, 55%, 57.5%, 60%, or 65%. The tri-level pieces optionally comprise at least 5% of the puzzle pieces. Nonlimiting examples include 5%, 6%, 7%, 8%, 9%, 10%, 11%, 12%, 13%, 14%, 15%, 16%, 20%, 25%, 30%, or 35%.

A third classification of the jigsaw puzzle pieces is by the change in tier elevation disposed on the multiple level puzzle pieces. For example, the puzzle pieces can be identified as having no change in tier elevation. In some variations, the puzzle pieces that do not change tier elevation comprise at least 35% of the puzzle pieces. Non-limiting examples include 35%, 37%, 40%, 42.5%, 45%, 47.5%, 50%, 52.5%, or 55%. Variations of the invention include puzzle pieces having one tier elevation change, and optionally comprise at least 25% of the puzzle pieces. Non-limiting examples include 25%, 26%, 27%, 28%, 29%, 30%, 35%, 37%, 40%, or 45%. The puzzle pieces can also include a two-tier elevation change that comprise at least 12% of the puzzle pieces. Non-limiting examples include 12%, 13%, 14%, 15%, 16%, 17%, 18%, 19%, 20%, 21%, 22%, 23%, 24%, 25%, 26%, 27%, 28%, 29%, 30%, 31%, 32%, or 33%. The puzzle pieces can include a three-tier elevation change, that comprise at least 8% of the puzzle pieces. Non-limiting examples include 8%, 9%, 10%, 11%, 12%, 13%, 14%, 15%, 16%, 17%, 18%, 19%, 20%, 22.5%, or 25%. Alternatively, the classification can be used for the assembled puzzle, with the connected puzzle, pieces result in the piece classification. For example, a having one tier elevation change could have a two tier base puzzle with single tier upper puzzle piece assembled on the base puzzle forming a one tier elevation change from a tier 2 to a tier 3, or a two tier elevation change with a two tier base puzzle with two tier upper puzzle piece assembled on the base puzzle forming a two tier elevation change from a tier 2 to a tier 4.

Puzzle pieces may be identified as part of more than one classification. For example, multiple level piece 1+3+4 is identified in all 3 classifications. In the classification for visible tiers, it has a visible tier 1, a visible tier 3, and a visible tier 4. In the classification for piece part, it has one tri-level. And in the classification for change in tier elevation, it has a one tier elevation change, a two-tier elevation change, and a three tier elevation change.

The inventive multiple level jigsaw puzzle has border pieces that may have straight edge, jigsaw edge, or contoured edge. The border pieces are optionally comprised of a corner piece with two border edges and a knob or hole on each of the two non-border edges, and side pieces with one border edge and a knob or hole on the three non-border edges.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

The inventive multiple level jigsaw puzzle is designed to enhance the image and alter the strategy and assembly used in completing jigsaw puzzles. The pieces include single level pieces and multiple level puzzle pieces. The puzzle pieces include at least a base tier, and optionally one or more elevated tiers are disposed on the base tier. The multiple level puzzle pieces optionally have one elevated tier, or two elevated tiers, and can include one elevation change, two elevation changes, or three elevation changes. The puzzle pieces of the multiple level puzzle are optionally up to 3 tiers thick. The tier elevation changes optionally include two separate visible tiers or three separate visible tiers. The multiple level puzzle optionally includes a contoured texture disposed on the top face of the puzzle pieces, designed to mimics a subject object.

As used herein, the singular forms "a," "an" and "the" include plural referents unless the context clearly dictates otherwise. Thus, for example, reference to "an insert" includes a single element or two or more elements.

As used herein, "about" means approximately or nearly and in the context of a numerical value or range set forth means±15% of the numerical.

As used herein, "adjacent" means a section of the puzzle in proximity to the puzzle piece when the puzzle is assembled.

Figure 4:
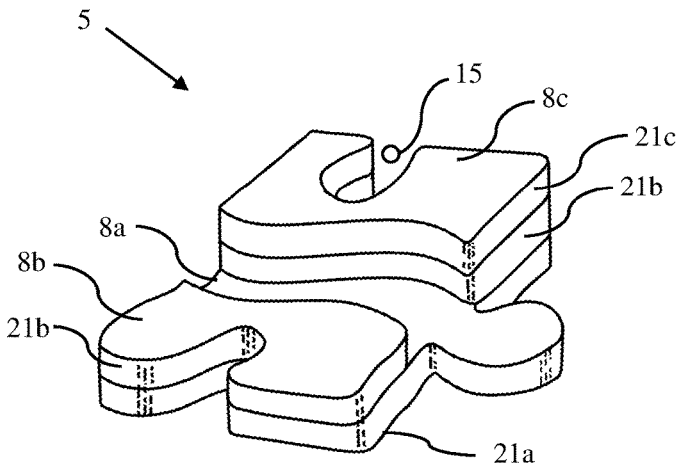
FIG. 4 is an isometric view of an upper puzzle piece showing multiple tiers, with numerous changes in elevation.

As used herein, "top" or "upper" and "lower" or "bottom" are referenced on the image depicted in FIG. 4. "Top" or "upper" means any portion of the puzzle directed to the top in FIG. 4. For example, reference number 21*b* is above reference number 21*a*. "Lower" or "bottom" is directed toward the bottom of FIG. 4.

As used herein, "complementary" means geometrically shaped and sized elements that conform to the adjacent element, such that a male element conforms to a female part to which it is being interconnected, or a female element conforms to a male element.

As used herein, "interlocking" means the respective pieces are united firmly together due to adjacent elements having complementary contours of recesses and projections.

As used herein, "visible" means the top face of the tier element is capable of being seen.

As used herein, "knob" means a protrusion extending from the edge of a puzzle piece. In some instances, the knob is rounded, though a protrusion is not required to be rounded to meet the definition herein.

As used herein, "hole" means a gap or opening along the edge of a puzzle piece, i.e. a section of the puzzle recessing in from the edge of the puzzle piece.

As used herein, "thickness" means the distance between the top face and the bottom face of a tier or puzzle piece.

As used herein, "tier" means one of a number of successively overlapping layers or rows placed one above the other to from multiple tiers. For a single tier puzzle piece, the puzzle piece may have overlapping tiers or may be formed on a single, base tier having no overlapping layers or rows. The tiers include the full row or a subset thereof. For example, where a tier is 1.6 mm thick, the tier can vary in thickness to accommodate a texture on the tier. In some examples, without being limited in scope, the 1.6 mm thick tier can vary from about 0.8 mm to 2.0 mm, accommodating a contoured texture that approximates the three-dimensional elements of an image, such as those depicted in FIGS. 18 and 19.

Ranges disclosed herein include subsets of the specified ranges.

Example 1

Figure 1:
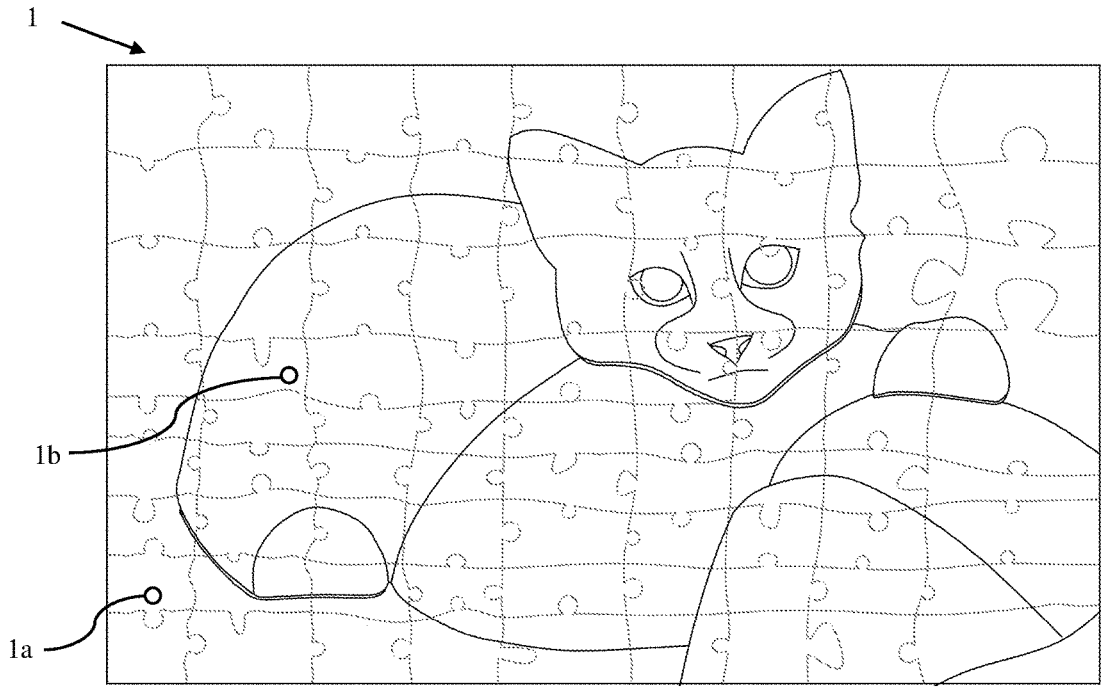
FIG. 1 is a top-down view of a tier-on-tier multilevel jigsaw puzzle in an embodiment of the invention.
Figure 2A:
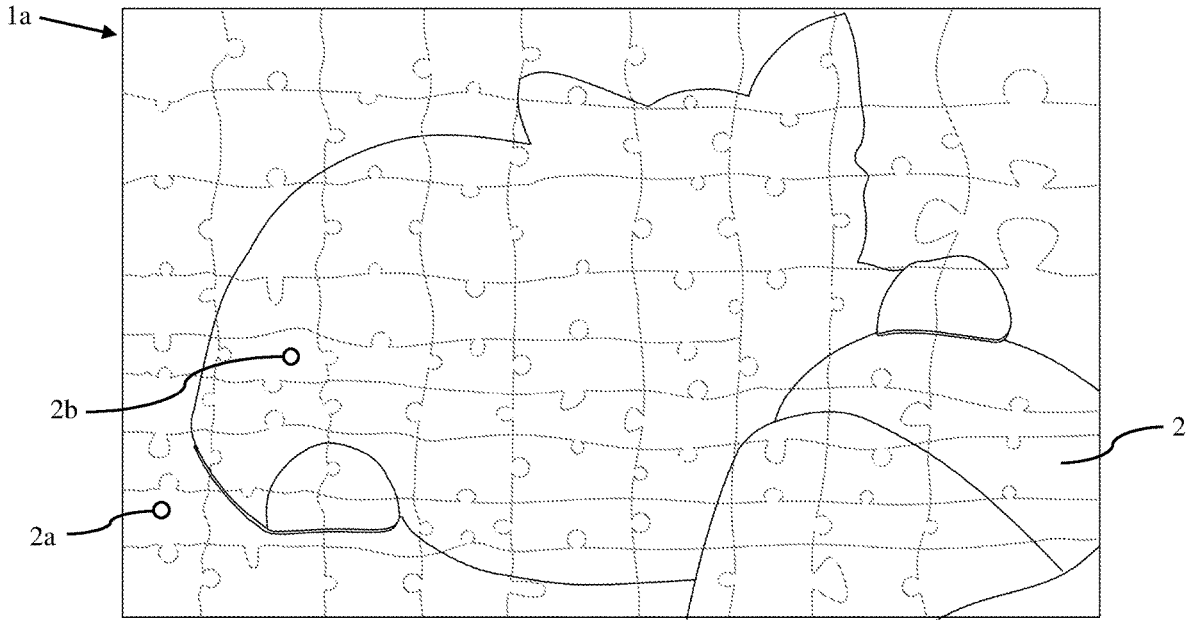
FIG. 2*a* is a top-down view of a tier-on-tier multilevel jigsaw puzzle in an embodiment of the invention, showing the base puzzle and without the upper puzzle.

Tier-on-tier multiple level jigsaw puzzle 1 is formed of base puzzle 1*a* and upper puzzle 1*b*, as seen in FIG. 1. Base puzzle 1*a* is composed of a plurality of base puzzle piece 2, which form base puzzle face 2*a* and base puzzle upper puzzle interface 2*b*, seen in FIG. 2*a*. Base puzzle face 2*a* is visible upon completion of the tier-on-tier multiple level jigsaw puzzle, whereas base puzzle upper puzzle interface 2*b* is concealed by upper puzzle 1*b* upon completion of the puzzle. As such, puzzle upper puzzle interface 2*b* optionally includes fun facts about the upper puzzle image or words, a repeat of the upper image, color, pattern or area called lower puzzle or level.

Figure 2B:
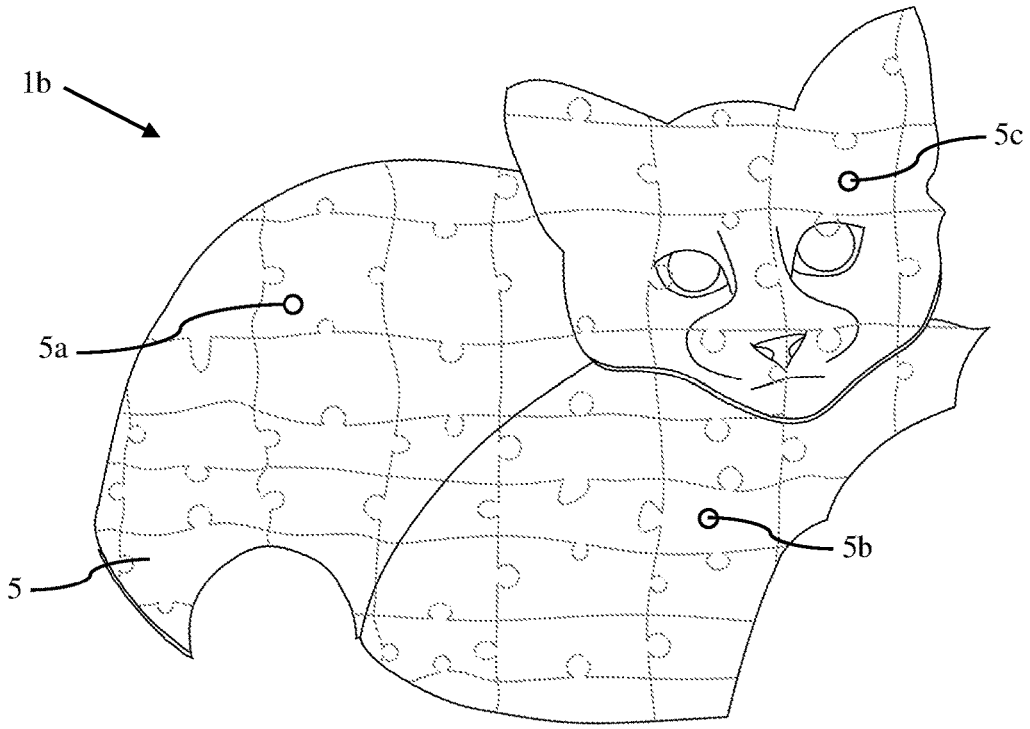
FIG. 2*b* is a top-down view of a tier-on-tier multilevel jigsaw puzzle in an embodiment of the invention, showing the upper puzzle.

Upper puzzle 1*b* is composed of a plurality of upper puzzle piece 5, which form the upper elevated structure of tier-on-tier multiple level jigsaw puzzle 1. Upper puzzle 1*b* optionally includes numerous changes in elevation, resulting in upper puzzle first elevation 5*a*, upper puzzle second elevation 5*b*, and upper puzzle third elevation 5*c*, as seen in FIG. 2*b*.

Figure 3:
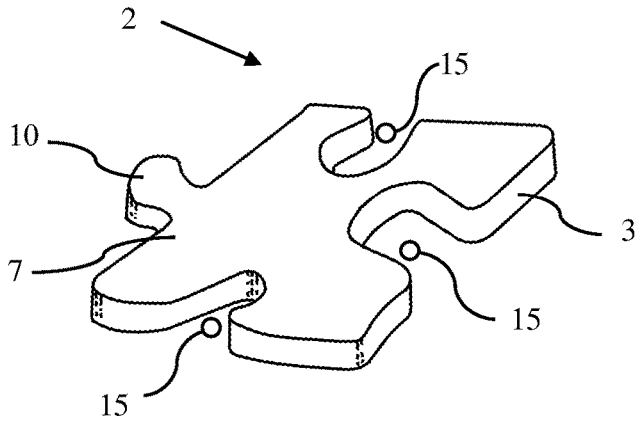
FIG. 3 is an isometric view of a base puzzle piece showing a single tier embodiment of the invention.

Each of the plurality of base puzzle piece 2, is composed of at least base tier 3, as seen in FIG. 3. Knob 10 is positioned on one or more tiers and dimensioned to engage, or interlock with, hole 15 on an adjacent piece, thereby locking the two adjacent puzzle pieces together. Hole 15 is similarly positioned on one or more tiers to engage knob 10 of an adjacent puzzle piece. The puzzle pieces may include any combination of knobs and holes along the edges of the piece. Further, the puzzle pieces include along the irregular edges of the piece, which are complementary to the geometry on an adjacent puzzle piece. Base tier face 7 is disposed on the upper face of the base tier.

Figure 5:
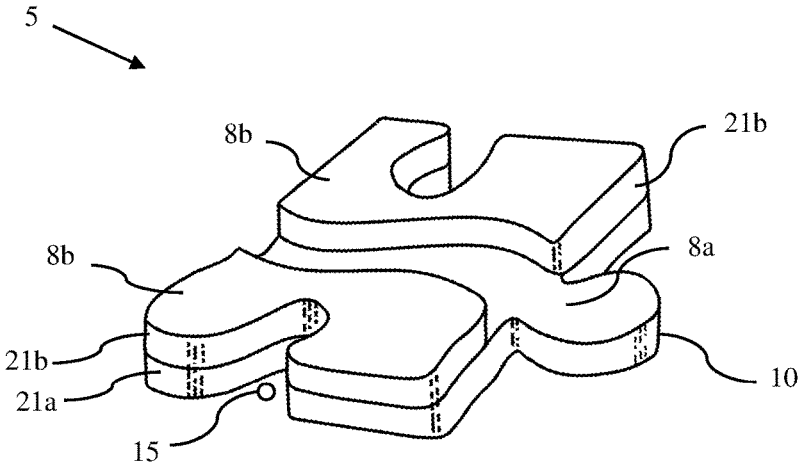
FIG. 5 is an isometric view of an upper puzzle piece showing multiple tiers, with a single elevation change.

Upper puzzle piece 5 is a multiple tier puzzle piece formed having two or more different visible tiers on the same piece, as seen in FIGS. 4 through 7. Upper puzzle piece 5 includes upper puzzle piece base tier 21*a* and at least one elevated tier. Upper puzzle piece 5 optionally has numerous changes in elevation, as seen in FIG. 4, where the elevation difference is one tier between upper puzzle piece base tier 21*a* and a first elevated tier on a subsection of the puzzle piece and the elevation difference is two or more tiers on a different subsection of the puzzle piece. For example, upper puzzle piece base tier 21*a* and upper puzzle piece first elevated tier 21*b* form a first elevated tier on one section of the puzzle piece, resulting in upper puzzle piece bottom face 8*a* and upper puzzle piece first elevated face 8*b*. On another section of the upper puzzle piece, the elevation difference is two tiers between upper puzzle piece base tier 21*a* and upper puzzle piece second elevated tier 21*c*, resulting in upper puzzle piece bottom face 8*a* and upper puzzle piece second elevated face 8*c*. As with the base puzzle pieces, upper puzzle piece 5 includes holes and knobs. Of note, where the holes and knobs are present on sections of the puzzle piece having multiple tiers, the hole or knob extends throughout the tiers present on that particular section of the puzzle piece, as illustrated in the figure, i.e. the holes for each tier align with the hole in the adjacent tiers and knobs similarly align as seen in FIG. 5. Other embodiments of upper puzzle piece 5 possess one change in elevation, as seen in FIG. 5, where the elevation difference is one tier. In the figure, the piece is formed of upper puzzle piece base tier 21*a* and upper puzzle piece first elevated tier 21*b* having a smaller area than upper puzzle piece base tier 21*a*. Optionally, upper puzzle piece first elevated tier 21*b* can include a second upper puzzle piece first elevated tier 21*b*, as seen in the figure, whereby upper puzzle piece bottom face 8*a* is partially sandwiched between two upper puzzle piece first elevated face 8*b*.

Figure 6:
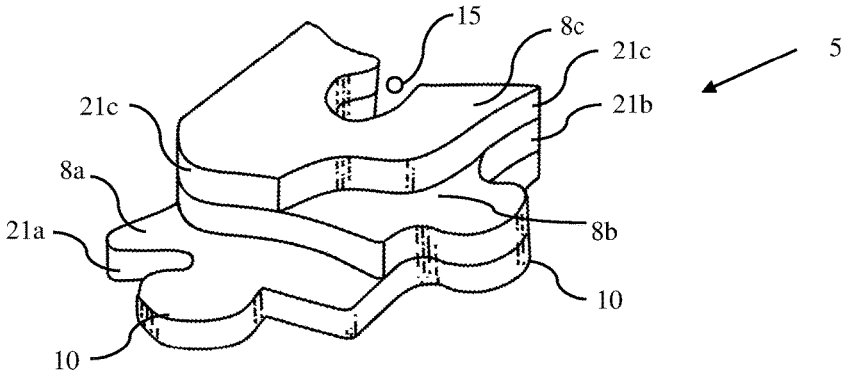
FIG. 6 is an isometric view of an upper puzzle piece having multiple changes in tier elevations and three visible tiers, in an embodiment of the invention.

Upper puzzle piece 5 can be formed having two or more different visible tiers on the same piece. For example, upper puzzle piece 5 can include visible sections of tier 1, 2, or top-most tier 3, in any combination, except that the top-most tier must be exposed. The multiple tier puzzle piece, the puzzle piece has two drops in elevation, as seen in FIG. 6. An example for this variation shows upper puzzle piece 5 with exposed, or visible, sections of tier 1, 2, and 3. Upper puzzle piece 5 includes upper puzzle piece base tier 21*a*, upper puzzle piece first elevated tier 21*b*, and upper puzzle piece second elevated tier 21*c*, where upper puzzle piece first elevated tier 21*b* and upper puzzle piece second elevated tier 21*c* have a smaller area than upper puzzle piece base tier 21*a*. Upper puzzle piece second elevated tier 21*c* has a smaller area than upper puzzle piece base tier 21*a* and upper puzzle piece first elevated tier 21*b*, resulting in the puzzle piece having three exposed faces and three exposed tiers.

Figure 7:
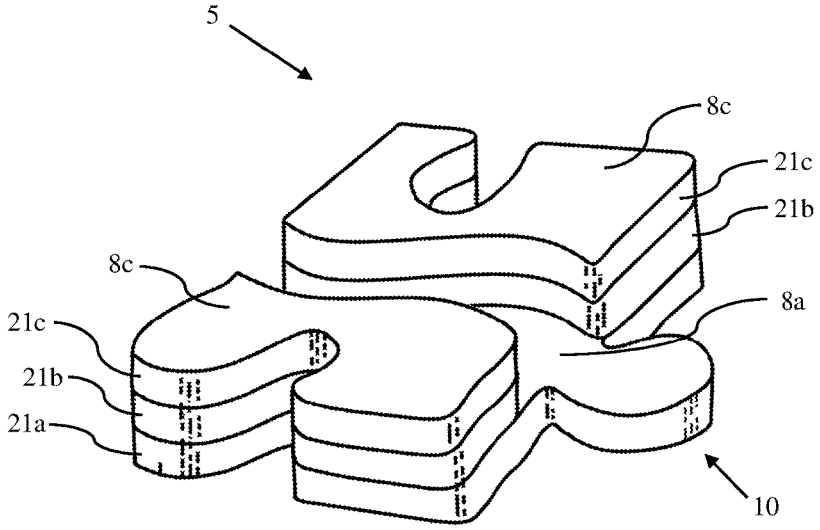
FIG. 7 is an isometric view of an upper puzzle piece having two changes in tier elevation, and three visible tiers in an embodiment of the invention. The piece can also be identified as a 3-1-3 piece.

In other variations of upper puzzle piece 5, the puzzle piece includes upper puzzle piece base tier 21*a*, upper puzzle piece first elevated tier 21*b*, and upper puzzle piece second elevated tier 21*c*, as seen in FIG. 7. Upper puzzle piece 5 results in upper puzzle piece first elevated tier 21*b* having the same size as upper puzzle piece second elevated tier 21*c*, and smaller than upper puzzle piece base tier 21*a*, as depicted in the figure.

Figure 8:
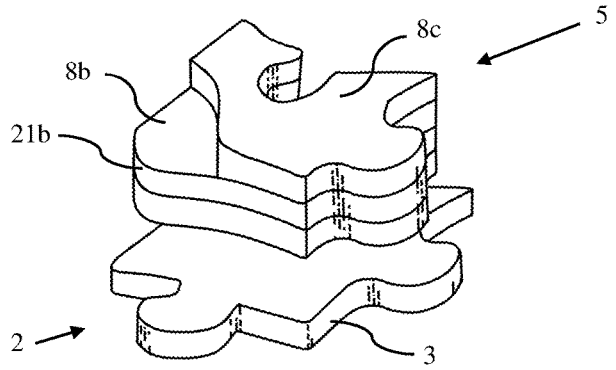
FIG. 8 is an isometric view of a base puzzle piece having a single tier and an upper puzzle piece having two visible tiers and one change in tier elevation, in an embodiment of the invention. Assembled, the base puzzle and upper puzzle combine, resulting in two changes in tier elevation.
Figure 9:
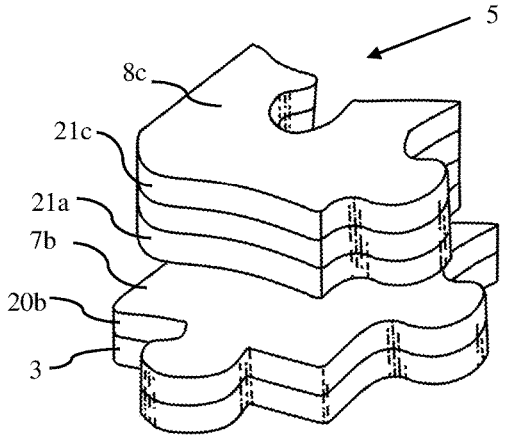
FIG. 9 is an isometric view of a base puzzle piece having two tiers and an upper puzzle piece having three tiers, in an embodiment of the invention. Assembled, the base puzzle and upper puzzle combine, resulting in a single change in tier elevation and a three tier change in elevation.

Tier-on-tier multiple level jigsaw puzzle 1 is assembled by completing base puzzle 1*a*, followed by upper puzzle 1*b*. After completing base puzzle 1*a*, upper puzzle piece 5 is placed over base puzzle piece 2, over puzzle upper puzzle interface 2*b*, as seen in FIGS. 8 and 9.

Example 2

Figure 10:
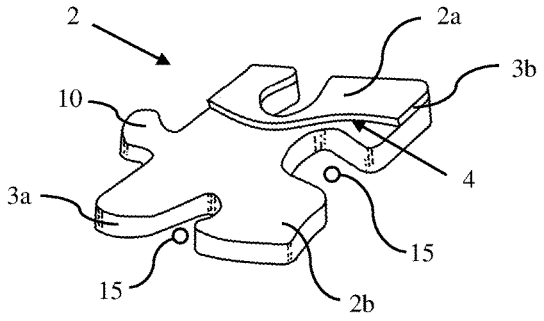
FIG. 10 is an isometric view of a base puzzle piece showing a single tier, with an indent interface in an embodiment of the invention.

Tier-on-tier multiple level jigsaw puzzle 1 is formed of base puzzle 1*a* and upper puzzle 1*b*, as described in Example 1. In this variation, the plurality of base puzzle piece 2, include a base puzzle piece indent interface between base puzzle face 2*a* and base puzzle upper puzzle interface 2*b*, i.e. a partial change in elevation between the base puzzle face 2*a* and base puzzle upper puzzle interface 2*b* as seen in FIG. 10. In these embodiments, base puzzle piece 2 includes base tier 3*a* and indent elevation 3*b*. Indent elevation 3*b* forms base puzzle piece indent interface 4 between base puzzle face 2*a* and base puzzle upper puzzle interface 2*b*. Notably, indent elevation 3*b* is substantially smaller than a tier elevation, typically having only sufficient thickness to secure upper puzzle 1*b*. In the illustrative example, indent elevation 3*b* has a thickness between 1/64 inch and 1/32 inch (between 0.4 mm and 0.8 mm).

Upper puzzle 1*b* is composed of a plurality of upper puzzle piece 5, as described in Example 1. Upper puzzle 1*b* optionally includes numerous changes in elevation, resulting in upper puzzle first elevation 5*a*, upper puzzle second elevation 5*b*, and upper puzzle third elevation 5*c*.

Figure 11:
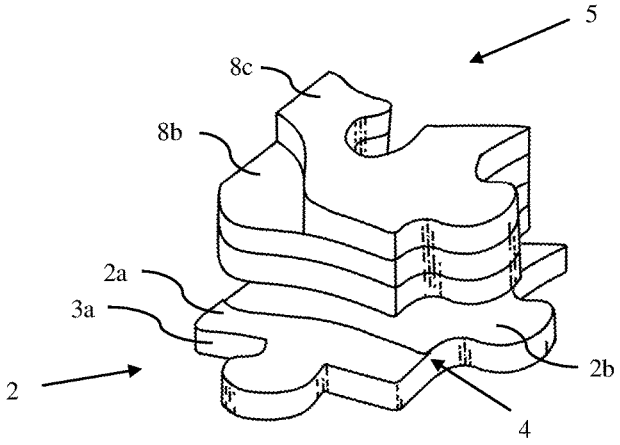
FIG. 11 is an isometric view of a base puzzle piece having a single tier, with an indent interface, and an upper puzzle piece of a three tier piece having two visible tiers and three changes in tier elevation, in an embodiment of the invention.
Figure 12:
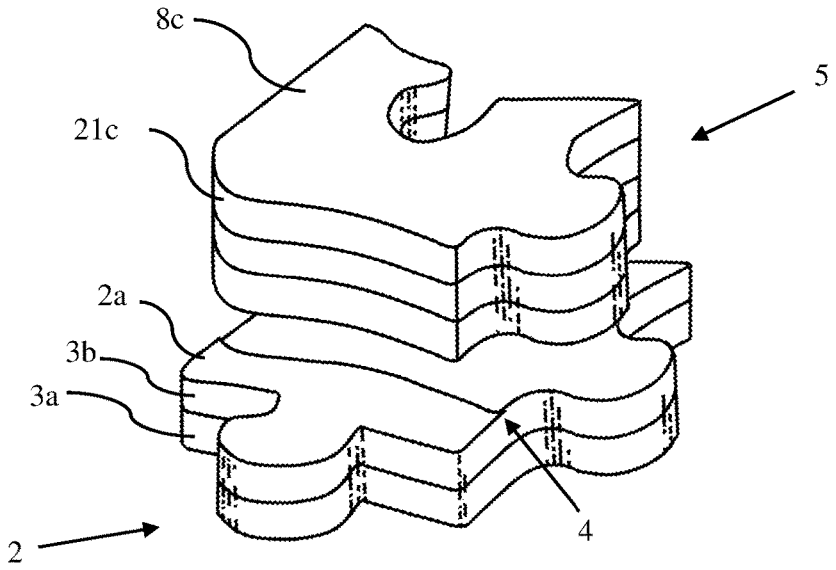
FIG. 12 is an isometric view of a base puzzle piece having two tiers, with an indent interface, and an upper puzzle piece of a three tier piece having one visible tier and three changes in tier elevation, in an embodiment of the invention.

Tier-on-tier multiple level jigsaw puzzle 1 is assembled by completing base puzzle 1*a*, followed by upper puzzle 1*b*. After completing base puzzle 1*a* in this variation, base puzzle 1*a* depicts a void to accept upper puzzle 1*b* defined by base puzzle piece indent interface 4. Upper puzzle piece 5 is placed over base puzzle piece 2, where the outermost edges of upper puzzle 1*b* fits against base puzzle piece indent interface 4, as seen in FIGS. 11 and 12.

Example 3

Figure 13:
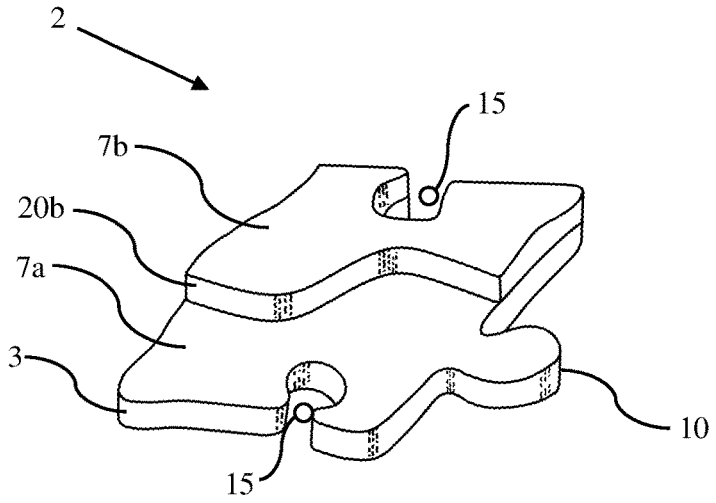
FIG. 13 is an isometric view of a base puzzle piece having a single tier, with an indent interface, in an embodiment of the invention.

Tier-on-tier multiple level jigsaw puzzle 1 is formed of base puzzle 1*a* and upper puzzle 1*b*, as discussed in prior Examples. Base puzzle 1*a* is composed of a plurality of base puzzle piece 2. Base puzzle piece 2 is composed of base tier 3, and base first elevated tier 20*b*, as seen in FIG. 13. Knob 10 is positioned on one or more tiers and dimensioned to engage, or interlock with, hole 15 on an adjacent piece, thereby locking the two adjacent puzzle pieces together. Hole 15 is similarly positioned on one or more tiers to engage knob 10 of an adjacent puzzle piece. The puzzle pieces may include any combination of knobs and holes along the edges of the piece. Base tier face 7*a* is disposed on the upper face of the base tier, and base upper tier face tier face 7*b* is disposed on the upper face of base first elevated tier 20*b*.

Figure 14:
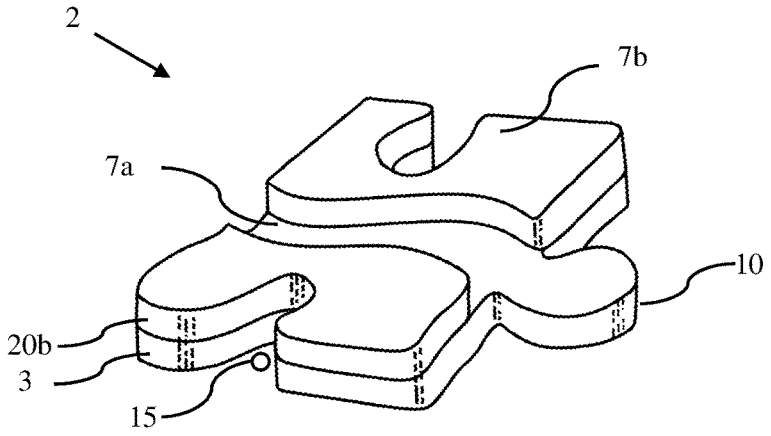
FIG. 14 is an isometric view of a base puzzle piece having multiple changes in tier elevations and two visible tiers, in an embodiment of the invention. The piece can also be identified as a 2-1-2 piece.

Alternatively, base puzzle piece 2 possess two changes of one tier in elevation, as seen in FIG. 14. In the figure, the piece is formed of base first elevated tier 20*b* having a smaller area than base tier 3, and disposed on a first section of base tier 3, and another base first elevated tier 20*b* having a smaller area than base tier 3, and disposed on a second section of base tier 3. Base tier face 7*a* is disposed on the upper face of the base tier, and base upper tier face tier face 7*b* is disposed on the upper face of base first elevated tier 20*b*. Base puzzle 1*a* includes base puzzle upper puzzle interface 2*b* as described in prior Examples.

Upper puzzle 1*b* is composed of a plurality of upper puzzle piece 5, as described in prior Examples. Upper puzzle 1*b* can interact with base puzzle pieces as disclosed in the various Examples herein to form tier-on-tier multiple level jigsaw puzzle 1.

Example 4

Figure 15:
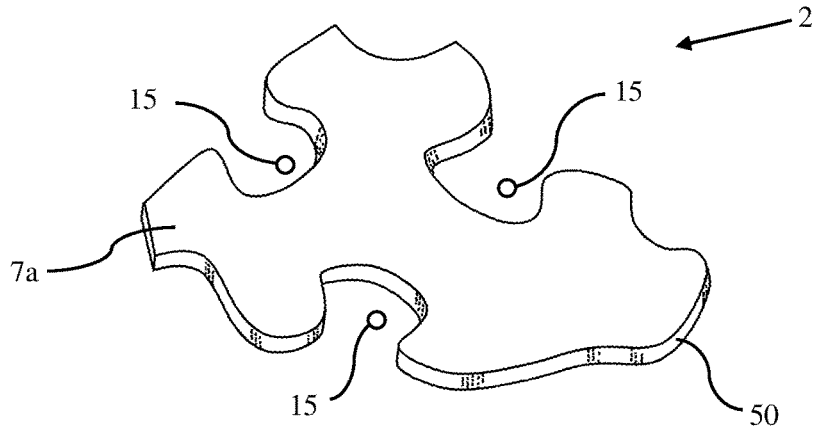
FIG. 15 is an isometric view of a base puzzle piece jigsaw puzzle piece with three irregular edges and three holes.

Tier-on-tier multiple level jigsaw puzzle 1 is formed of base puzzle 1*a* and upper puzzle 1*b*, as provided in the prior examples. However, unlike the prior examples, the puzzle pieces, when viewed by the major side elements and ignoring knobs and holes, approximate geometric shapes. For example, the puzzle pieces can approximate a triangle, as seen in FIG. 15. In the Figure, the puzzle piece approximates a right-angled triangle when holes 15 are ignored. The puzzle pieces can also approximate quadrilaterals, pentagons, hexagons, or heptagons. However, in most instances the plurality of puzzle pieces approximate an irregular rectangle. Irregular edges are not defined as holes or knobs if they do not interconnect. In the figure, irregular edge 50 is complementary to, and interlocks with an adjacent puzzle piece. In other embodiments, the puzzle piece is an upper puzzle piece. The puzzle piece can also be an edge or corner puzzle piece, such as 32, with a knob or hole on two sides and a straight third edge. Conversely, puzzle piece can also be an edge or corner puzzle piece of puzzle 35, such as 33. Edge or border puzzle piece 36 or 37 has a knob or hole on three sides.

Example 5

Figure 16:
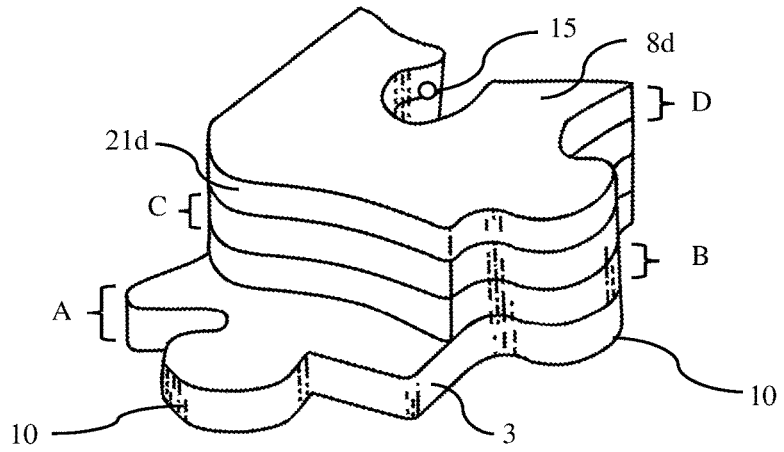
FIG. 16 is an isometric view of a multilevel jigsaw puzzle piece in an embodiment of the invention showing the tiers having different thicknesses.

Tier-on-tier multiple level jigsaw puzzle 1 is formed of base puzzle 1*a* and upper puzzle 1*b*. The puzzle has a maximum of either 3 tiers, 4 tiers, or 5 tiers, when assembled, as provided for in the previous Examples. The puzzle pieces forming the puzzle have one or more tiers, and optionally include a single-tier of base puzzle piece 2 and multiple-tier upper puzzle piece 5. In certain embodiments, the base tier of base puzzle piece 2 has a first thickness A and the tiers of upper puzzle piece 5 have a thickness which differs from first thickness A, as seen in FIG. 16. As seen in the figure, upper puzzle piece base tier 21*a* has a thickness B, upper puzzle piece first elevated tier 21*b* has a thickness C, and upper puzzle piece second elevated tier 21*c* has a thickness D. In specific embodiments, base tier 3 has a thickness of 1.6 mm or 1.9 mm. The elevated tiers, i.e. upper puzzle piece base tier 21*a*, upper puzzle piece first elevated tier 21*b*, upper puzzle piece second elevated tier 21*c*, and upper puzzle piece third elevated tier 21*d*, have a thickness of 1.2 mm to 1.6 mm. Optionally, thicknesses B through D have the same thickness. In a nonlimiting example, thicknesses B through D are all 1.2 mm or about 1.2 mm, and are the same thickness. Further, the puzzle piece average surface area varies, such as different puzzle pieces having surface areas of 0.7 sq.in. to 1.3 sq.in., but the pieces of the puzzle form an average surface area of at least 0.85 sq.in.

Example 6

The multiple level puzzle has a maximum of either 3 tiers, 4 tiers, or 5 tiers, when assembled, as provided for in the previous Examples. The puzzle pieces of the multiple level jigsaw puzzle have a varied design, based on the desired complexity of the puzzle. The puzzle pieces can be formed of six knob and hole variations; knob-hole-knob-hole, knob-knob-hole-hole, knob-knob-knob-hole, hole-hole-hole-knob, knob-knob-knob-knob, hole-hole-hole-hole. The composition of each variation alters the complexity of assembly, with puzzles containing more similarly constructed pieces increasing the complexity. For example, puzzles with a high composition of knob-hole-knob-hole pieces increase assembly difficulty, as the pieces cannot be distinguished by unique knob-hole combinations. To increase the ease of assembly, the puzzle piece composition is made of about an equal number of the six knob and hole combination.

Example 7

Figure 17:
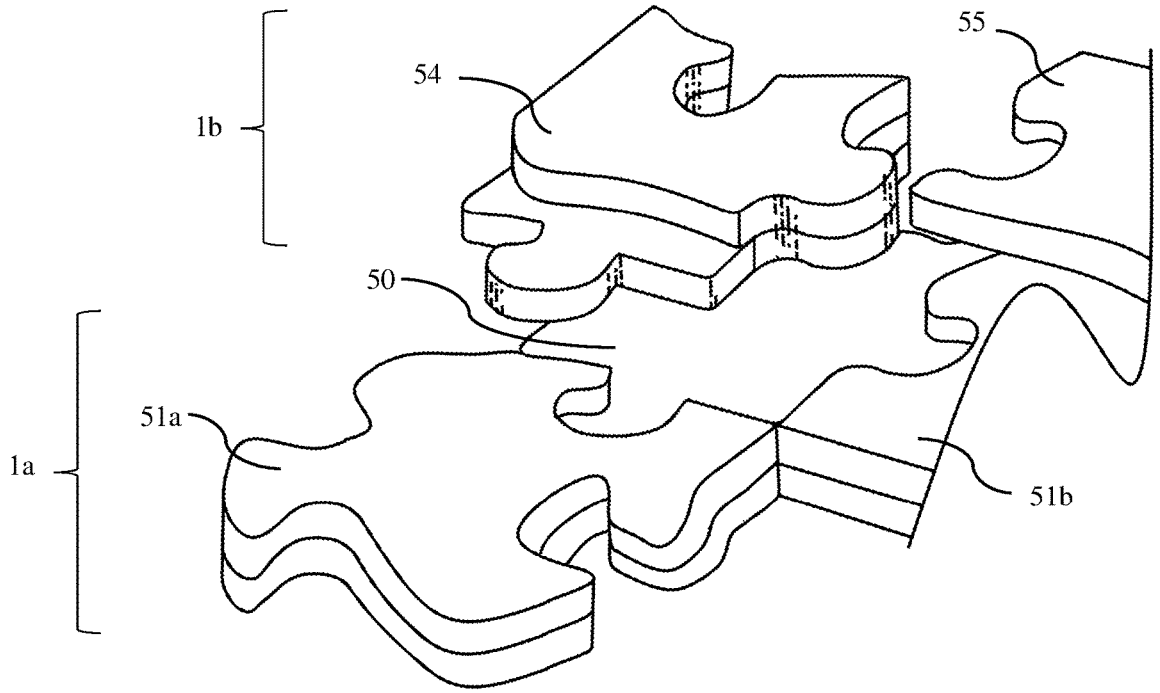
FIG. 17 is an isometric view of a plurality of jigsaw puzzle pieces that combine to fix, connect, or lock the upper puzzle to the lower puzzle in one variation of the invention.

Tier-on-tier multiple level jigsaw puzzle 1 is formed of base puzzle 1*a* and upper puzzle 1*b*, which are connected by one or more linking puzzle pieces, as seen in FIG. 17. In the example, base puzzle 1*a* is composed of a plurality of base puzzle pieces, including at least one single tier lower puzzle piece 50, and two-tier lower puzzle piece 51. Upper puzzle 1*b* is composed of a plurality of upper puzzle pieces, including at least one two-tier linking puzzle piece 54 and single tier upper puzzle piece 55. The single tier lower puzzle piece 50 is covered by two-tier linking puzzle piece 54 and forms a link between base puzzle 1*a* and upper puzzle 1*b*.

The base puzzle can be assembled first, such as linking single tier lower puzzle piece 50 with two-tier lower puzzle piece 51. After completion of the base puzzle, the upper puzzle is assembled on the base puzzle. Single tier upper puzzle piece 55 is assembled onto two-tier lower puzzle piece 51*b*. Two-tier linking puzzle piece 54 is assembled on single tier lower puzzle piece 50, fitting into the gap formed by two-tier lower puzzle piece 51*a* and two-tier lower puzzle piece 51*b* of the base puzzle and single tier upper puzzle piece 55 of the upper puzzle, causing two-tier linking puzzle piece 54 join the base puzzle and upper puzzle. The upper face of single tier lower puzzle piece 50 optionally includes printed facts, textures, colors, images, patterns, or other features listed in the puzzle interface.

Example 8

Tier-on-tier multiple level jigsaw puzzle 1 is formed of base puzzle 1*a* and upper puzzle 1*b*, similar to the structure described in Example 7. In this example, the base puzzle 1*a* and upper puzzle 1*b* are composed of a plurality single-tier puzzle pieces and two-tier puzzle pieces, as seen in FIG. 17. The two-tier and single-tier puzzle pieces interact to interlock the upper puzzle and base puzzle together.

Example 9

Figure 18:
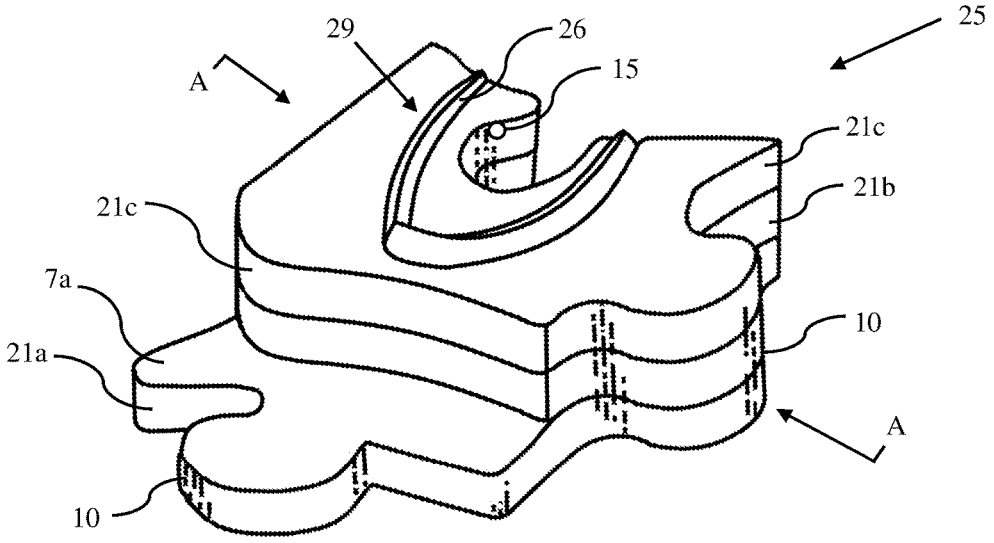
FIG. 18 is an isometric view of a multilevel jigsaw puzzle piece with a contour textured surface in an embodiment of the invention.

The multiple level jigsaw puzzle is formed of a plurality of contour textured multilevel puzzle pieces and contour textured single level puzzle pieces, similar to the multilevel puzzle pieces of Examples 1 through 6. The puzzle pieces include contour textured puzzle piece 25, formed as single level puzzle pieces or multilevel puzzle pieces. The contour textured single level puzzle piece can be at any elevation. As such, the contour textured single level puzzle piece can be a base level or a single elevated tier, formed of base puzzle 1*a* and upper puzzle 1*b*. The multilevel puzzle piece has two or more changes in elevation. The multilevel puzzle piece includes a base level and upper tier, as discussed in the prior Examples. For example, the contour textured multilevel puzzle piece can possess a single change in elevation, where the elevation difference is a single tier. In other variations of the contour textured multilevel puzzle piece, the puzzle piece has a change in elevation covering multiple tiers, as seen in FIG. 18. In other variations of the invention, the puzzle piece includes two drops in elevation, or puzzle pieces which include two changes in elevation from a first elevation to a second elevation and back to the first elevation.

Figure 19:
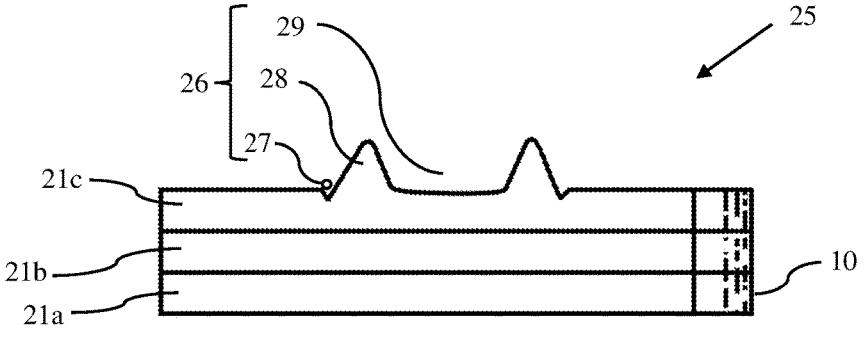
FIG. 19 is a cross sectional view of FIG. 18 at location A-A, showing the multiple contour textured surfaces.

The top-most tier of the contour textured puzzle piece 25 has textured face 29, such as an ear seen in FIG. 18. The textured face is formed from contoured relief 26. Contoured relief 26 includes contour indent 27, contour projection 28, or a combination of the indent and projection, as seen in FIG. 19. Assembly of the multiple level puzzle pieces proceeds similarly to Examples 1 through 6, with the subject image, and optionally background, having a gentle relief mimicking the imagery of the puzzle subject.

Example 10

Contour textured puzzle piece 25 is formed of puzzle pieces as disclosed in the previous Examples. The base puzzle has at least base tier 3, having a thickness of 1.6 mm. For base puzzle piece 2 formed of elevated tiers, i.e. base first elevated tier 20*b*, the elevated tier has a minimum thickness of 1.2 mm. Upper puzzle piece 5 is formed of elevated tiers, such as upper puzzle piece base tier 21*a*, upper puzzle piece first elevated tier 21*b*, and upper puzzle piece second elevated tier 21*c*, whereby each of the elevated tiers has a minimum thickness of 1.2 mm. Embodiments of this example have a contoured relief 25 which does not extend beyond the thickness of the tier, i.e. the relief does not exceed 1.2 mm. The puzzle pieces assemble to form edged puzzle 30 having a raised relief image, or jigsaw edged puzzle 35 having a relief image.

Example 11

Figure 20:
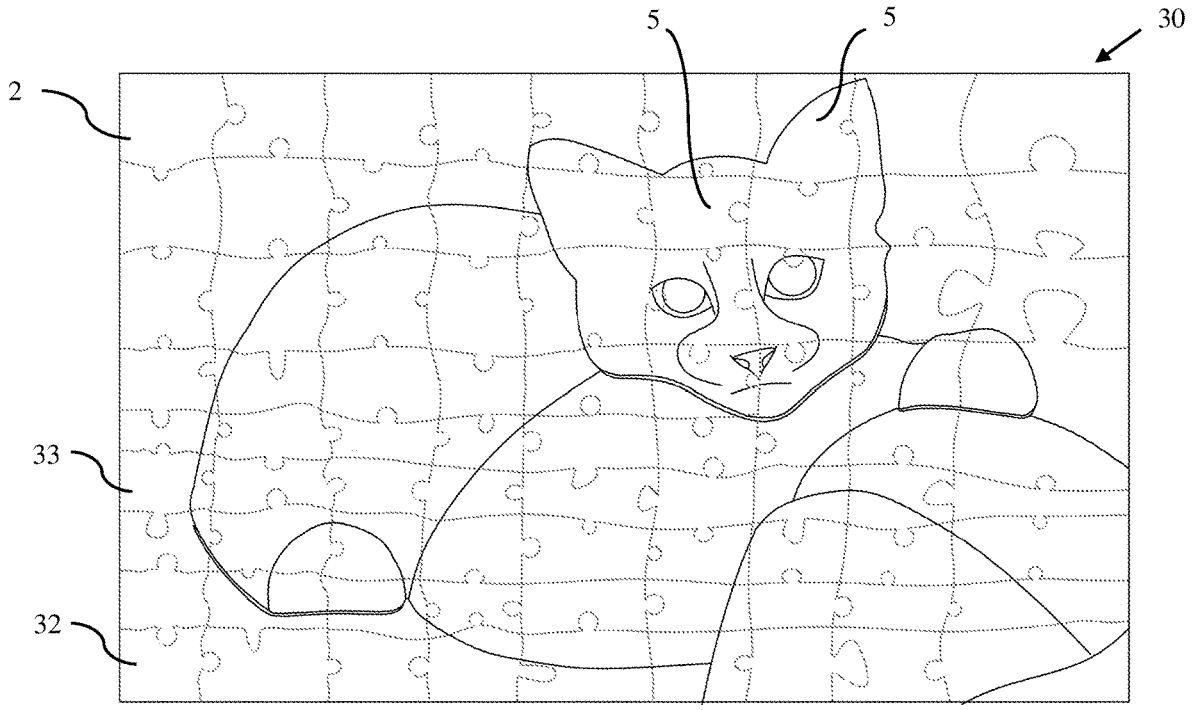
FIG. 20 is a top-down view of a multilevel jigsaw puzzle in an embodiment of the invention. In the disclosed embodiment, the puzzle has a straight-edged border.

The multiple level puzzle has a maximum of either 3 tiers, 4 tiers, or 5 tiers, when assembled, as provided for in the previous Examples. The puzzle pieces include knob 10 hole 15 along the irregular edges of the piece, which interlock and are complementary to the knob and hole on an adjacent puzzle piece. Straight edged puzzle 30 has edges of the puzzle border which are straight, regardless of the tier, i.e. the base tier and any elevated tier contacting the edge of the puzzle have a straight edge, as seen in FIG. 20. The subject image has a contoured edge, mimicking the subject image or a portion thereof. In some embodiments, the image possesses various levels, such as a second level for the subject rear body, a third level for the subject front body, and a fourth level for the subject head.

Figure 21:
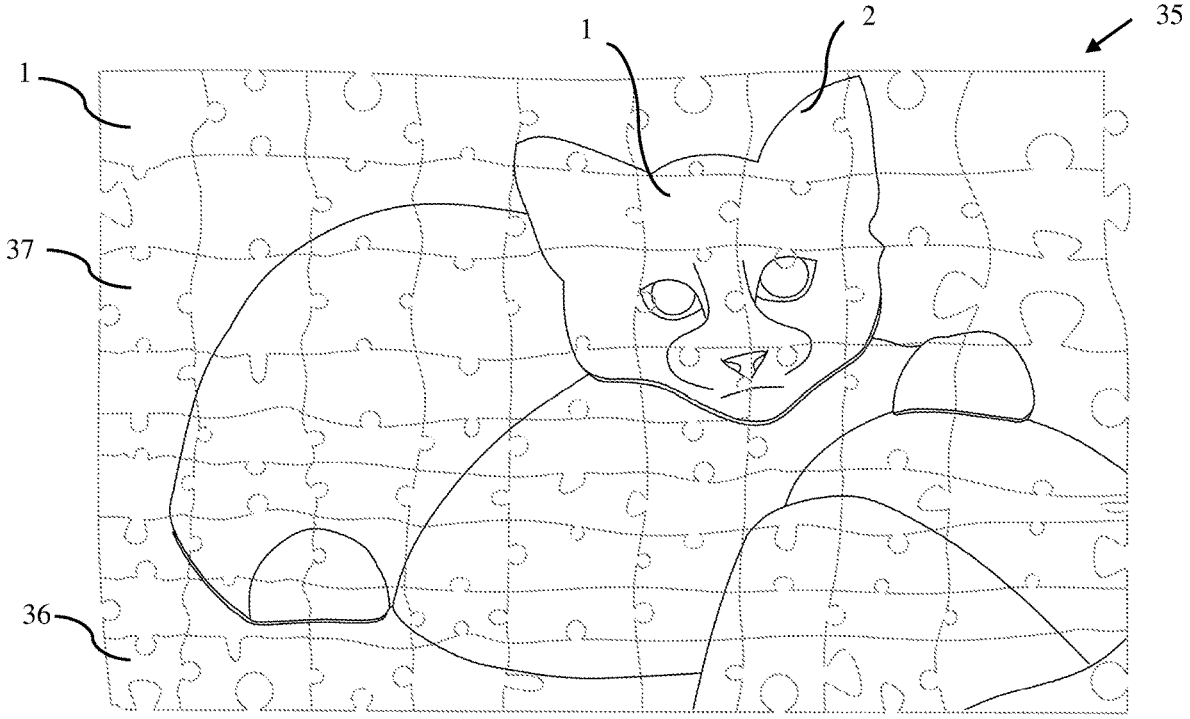
FIG. 21 is a top-down view of a multilevel jigsaw puzzle in an embodiment of the invention. In the disclosed embodiment, the puzzle has a jigsaw-edged border.

Jigsaw edged puzzle 35, seen in FIG. 21, is formed of a plurality of multilevel puzzle pieces and single level puzzle pieces, as disclosed in Example 1. Jigsaw edged puzzle 35 has edges of the puzzle border which mimic the jigsaw edges, i.e. the puzzle edges have puzzle pieces including knob 10 and hole 15 along the puzzle edges. The knob or hole on the border edge does not interlock with an adjacent piece and can be simply an irregular edge. The edges include base tier and any elevated tier contacting the edge of the puzzle. The subject image has a contoured edge, mimicking the subject image or a portion thereof. In some embodiments, the image possesses various levels, such as a second level for the subject rear body, a third level for the subject front body, and a fourth level for the subject head.

Example 12

The puzzle pieces of the multiple level jigsaw puzzle, described in the previous Examples, have three tiers; a base tier, a first elevated tier, and a second elevated tier. In this embodiment, the base tier has a thickness of 1.9 mm, the first elevated tier has a thickness of 1.9 mm, and the second elevated tier has a thickness of 1.9 mm. The breakdown of percentages of puzzle pieces are a minimum of 40% of the puzzle pieces have only a base tier, i.e. tier 1; and 40% of the puzzle pieces have maximum elevated tier of a first elevated tier or visible tier 2. Alternatively, the puzzle pieces are a minimum of 40% of the puzzle pieces have only a base tier; a minimum of 40% of the puzzle pieces have a base tier and first elevated tier, i.e. tier 2; and a minimum of 20% of the puzzle pieces have all three tiers, or tier 3.

Example 13

The puzzle pieces of the multiple level jigsaw puzzle, described in the previous Examples, have four tiers on the completed puzzle; a base tier on the base puzzle, a base tier on the upper puzzle piece, a first elevated tier on the upper puzzle piece, and a second elevated tier on the upper puzzle piece. In this embodiment, the base tier has a thickness of 1.6 mm, and an upper puzzle base tier has a thickness of 1.6 mm, the first elevated tier has a thickness of 1.6 mm, and the second elevated tier has a thickness of 1.6 mm. The breakdown of percentages of puzzle pieces are a minimum of 30% of the puzzle pieces have only a base tier, i.e. tier 1; a minimum of 15% of the puzzle pieces have a base tier and first elevated tier, i.e. tier 2; and a minimum of 15% of the puzzle pieces have three tiers, or tier 3.

Example 14

The puzzle pieces of the multiple level jigsaw puzzle, described in the previous Examples, have five tiers when completed; for example a base tier on the base puzzle piece; a base tier on the upper puzzle piece, a first elevated tier on the upper puzzle piece, a second elevated tier on the upper puzzle piece, a third elevated tier on the upper puzzle piece, and a fourth elevated tier on the upper puzzle piece. Alternatively, the puzzle may have a base tier on the base puzzle piece, and a first elevated tier on the upper puzzle piece; and a base tier on the upper puzzle piece, a first elevated tier on the upper puzzle piece, and a second elevated tier on the upper puzzle piece. In this embodiment, the base tier has a thickness of 1.6 mm, the first elevated tier has a thickness of 1.2 mm, the second elevated tier has a thickness of 1.2 mm, and the third elevated tier (in those examples) has a thickness of 1.2 mm. The breakdown of percentages of puzzle pieces are a minimum of 30% of the puzzle pieces have only a base tier, i.e. tier 1; a minimum of 15% of the puzzle pieces have a base tier and first elevated tier, i.e. tier 2; a minimum of 15% of the puzzle pieces have three tiers, or tier 3; a minimum of 15% of the puzzle pieces have four tiers, or tier 4.

Example 15

The puzzle pieces of the multiple level jigsaw puzzle, described in any one of the previous Examples, can be classified based on the highest number of visible tiers disposed on the puzzle piece of a completed puzzle. For example, the single level puzzle pieces can be classified as visible tier 1 or 2 on the completed puzzle; visible tier 1, 2, or 3, for variations having up to 3 tiers on the completed puzzle; depending on the number of elevated tiers. Multiple level pieces can also be classified by their visible tiers. For example, a multiple level piece with a tier 1 and a tier 3, or 1+3 puzzle piece, is classified both as a visible tier 1 and a visible tier 3. In such classification, to meet the enhanced image and assembly strategy goals of the invention, the puzzle pieces for any of Examples 1 through 5, 7, or 8, are formed such that at least 40% of the puzzle pieces contain a visible tier 1 classification, and at least 40% fall into a visible tier 2 classification. In examples having 3 tiers, at least 40% of the puzzle pieces contain a visible tier 1 classification, at least 20% fall into a visible tier 2 classification, and at least 20% fall into a visible tier 3 classification.

Example 16

The puzzle pieces of the multiple level jigsaw puzzle, described in any one of the previous Examples, can be classified based on the type of puzzle piece, or piece type. The specific piece types include flat, bi-level, and, in some variations, tri-level. In such classification, to meet the enhanced image and assembly strategy goals of the invention, the puzzle pieces for any of Examples 1 through 4 are formed such that at least 20% of the puzzle pieces fall into a flat classification, meaning the puzzle pieces do not change elevation. At least 35% of the puzzle pieces fall into a bi-tier classification, meaning there are two separate tiers on the puzzle piece. At least 5% of the puzzle pieces fall into a tri-tier classification, or the puzzle piece contains three separate tiers on the piece. The classification may also be undertaken for a completed puzzle.

Example 17

The puzzle pieces of the multiple level jigsaw puzzle, described in any one of the previous Examples, can be classified based on the change in tier elevation on the completed puzzle. The specific changes in tier elevation include one, two, and/or three. In such classification, to meet the enhanced image and assembly strategy goals of the invention, the puzzle pieces for any of Examples 1 through 4 are formed such that at least 25% of the puzzle assemblies have one change in tier elevation, such as from the base tier to tier 2, from tier 2 to tier 3, i.e. 2+3, etc. At least 12% of the puzzle assemblies have two changes in tier elevation, such as from the base tier to tier 3, i.e. 1+3, from tier 2 to tier 4, i.e. 2+4 piece. The pieces can assemble to form multiple changes in elevation such as from the base tier to tier 3 and to tier 2, i.e. 1+2+4 assembly. In some variations of the invention, at least 8% of the puzzle pieces have a three-tier changes in tier elevation, such as from the base tier to tier 4, or 1+4 piece. The pieces can assemble to form multiple changes in elevation such as from the base tier to tier 4 and to tier 1, i.e. 1+2+5 assembly. The remaining pieces do not have a change in elevation, either the base tier or a flat elevated tier. At least 35% of the puzzle pieces are puzzle pieces having no change in tier elevation.

Example 18

Tier-on-tier multiple level jigsaw puzzle 1 is formed of base puzzle 1*a* and upper puzzle 1*b*, as provided in the prior examples. The tier-on-tier multiple level puzzle has a maximum of either 3 tiers, 4 tiers, or 5 tiers, when assembled, as provided for in any of prior Examples 1 through 9. The puzzle pieces include knob 10 hole 15 along the edges of the puzzle pieces, which interlock and are complementary to the knob and hole on an adjacent puzzle piece. Straight edged puzzle 30 has edges of the puzzle border which are straight, regardless of the tier, i.e. the base tier and any elevated tier contacting the edge of the puzzle have a straight edge, as seen in FIG. 20. In some embodiments, corner puzzle piece 32 has a knob or hole on two sides. Edge or border puzzle piece 33 has a knob or hole on three sides.

Example 19

Tier-on-tier multiple level jigsaw puzzle 1 is as provided in the prior examples, having jigsaw edge. Jigsaw edged puzzle 35, seen in FIG. 21, is formed of a plurality of multilevel puzzle pieces and single level puzzle pieces, as disclosed in any of prior Examples 1 through 9. Jigsaw edged puzzle 35 has edges of the puzzle border which mimic the jigsaw edges, i.e. the puzzle edges have puzzle pieces including knob 10 and hole 15 along the puzzle edges for jigsaw corner puzzle piece 36 and jigsaw border puzzle piece 37. The knob or hole on the border edge does not interlock with an adjacent piece and can be simply an irregular edge. The edges include base tier and any elevated tier contacting the edge of the puzzle. The subject image has a contoured edge, mimicking the subject image or a portion thereof. In some embodiments, the image possesses various levels, such as a second level for the subject rear body, a third level for the subject front body, and a fourth level for the subject head.

The disclosures of all publications cited above are expressly incorporated herein by reference, each in its entirety, to the same extent as if each were incorporated by reference individually.

It is also to be understood that the following claims are intended to cover all of the generic and specific features of the invention herein described, and all statements of the scope of the invention which, as a matter of language, might be said to fall there between. Now that the invention has been described, what is claimed is:

What is claimed is:

1. A tier-on-tier multiple level jigsaw puzzle, wherein the tier-on-tier multiple level jigsaw puzzle comprises a plurality of puzzle pieces further comprising:

a base puzzle composed of a plurality of base puzzle pieces forming a base puzzle face and base puzzle upper puzzle interface;

wherein the base puzzle face is composed of an image adapted to interact with an upper puzzle to form a tiered or three-dimensional image;

wherein the base puzzle upper puzzle interface is composed of printed facts pertaining to the tiered or three-dimensional image of the puzzle, a color, a message, a lip bordering the base puzzle upper puzzle interface, a pattern, or textured material adapted to engage a bottom face of the upper puzzle, or a recreation of an image from the base puzzle on the upper puzzle;

wherein the plurality of base puzzle pieces further comprise:

a plurality of single tier puzzle pieces, wherein the single tier puzzle pieces comprise:

at least a base tier, wherein the base tier has a top face, a bottom face, and at least three irregular edges disposed between the top face and the bottom face;

at least one knob or hole disposed on at least one irregular edge of the at least a base tier, wherein the knob or hole is complementary to and interlocking with an adjacent puzzle piece;

a plurality of multiple tier base puzzle pieces, wherein the multiple tier base puzzle pieces comprise:

a base tier, wherein the base tier has a top face, a bottom face, and at least three irregular edges disposed between the top face and the bottom face;

at least one base knob or base hole disposed on one of the at least three irregular edges;

a first elevated tier disposed on the top face of the base tier, wherein the first elevated tier has a first tier top face and a first tier bottom face, and is at a first height;

at least one irregular edge disposed between the first elevated tier top face and the first elevated tier bottom face and correlating with one of the at least three irregular edges disposed on the base tier;

at least one knob or hole disposed on at least one irregular edge of the first elevated tier and aligned with at least one base knob or base hole, respectively, wherein the knob or hole is complementary to and interlocking with an adjacent puzzle piece;

an upper puzzle composed of a plurality of upper puzzle pieces, wherein the upper puzzle pieces further comprise:

a plurality of single tier upper puzzle pieces, wherein the single tier upper puzzle pieces comprise:

a first tier, wherein the first tier has a top face, a bottom face, and at least three irregular edges disposed between the top face and the bottom face;

at least one knob or hole disposed on at least one irregular edge of the at least a first tier, wherein the knob or hole is complementary to and interlocking with an adjacent puzzle piece;

at least one multiple tier upper puzzle piece, wherein the multiple tier upper puzzle piece further comprises:

a first tier, wherein the first tier has a top face, a bottom face, and at least three irregular edges disposed between the top face and the bottom face;

at least a first elevated tier disposed on the top face of the first tier, wherein the first elevated tier has a first tier top face and a first tier bottom face, and is at a first height;

at least one knob or hole disposed on at least one irregular edge of the first tier and first elevated tier, wherein the knob or hole is complementary to and interlocking with an adjacent puzzle piece; and wherein at least one puzzle piece forming the upper puzzle engages at least one puzzle piece forming the base puzzle to fix the upper puzzle to the base puzzle.

2. The tier-on-tier multiple level jigsaw puzzle of claim 1, wherein the base tier of the plurality of single tier puzzle pieces has a thickness of about 1.6 mm to about 1.9 mm.

3. The tier-on-tier multiple level jigsaw puzzle of claim 1, wherein the base tier of the plurality of multiple tier puzzle pieces has a thickness of about 1.6 mm to about 1.9 mm.

4. The tier-on-tier multiple level jigsaw puzzle of claim 3, wherein the first elevated tier of the multiple tier base puzzle or the first elevated tier of the multiple tier upper puzzle piece has a thickness of about 1.2 mm to about 1.9 mm.

5. The tier-on-tier multiple level jigsaw puzzle of claim 1, wherein the plurality of puzzle pieces are cardboard, wood, paperboard, chipboard, or plastic.

6. The tier-on-tier multiple level jigsaw puzzle of claim 1, wherein the completed puzzle is between 3 tiers thick and 5 tiers thick.

7. The tier-on-tier multiple level jigsaw puzzle of claim 1, wherein the plurality of puzzle pieces has an average planar or surface area of at least 0.85 square inches.

8. The tier-on-tier multiple level jigsaw puzzle of claim 1, wherein the plurality of single tier puzzle pieces of the base puzzle, the plurality of single tier puzzle pieces of the upper puzzle, the plurality of multiple tier puzzle pieces of the base puzzle, and the at least one multiple tier puzzle piece of the upper puzzle are comprised of the following:

at least 40% of the pieces have a maximum elevated tier of a base tier or visible tier 1; and at least 40% of the pieces have a maximum elevated tier of a first elevated tier or visible tier 2.

9. The tier-on-tier multiple level jigsaw puzzle of claim 1, wherein the upper puzzle forms at least 25% of the total piece count of the puzzle.

10. The tier-on-tier multiple level jigsaw puzzle of claim 1, wherein the plurality of single tier puzzle pieces of the base puzzle, the plurality of single tier puzzle pieces of the upper puzzle, the plurality of multiple tier puzzle pieces of the base puzzle, and the at least one multiple tier puzzle piece of the upper puzzle are comprised of the following:

at least 30% of the pieces have a maximum elevated tier of a base tier or visible tier 1;

at least 15% of the pieces have a maximum elevated tier of a first elevated tier or visible tier 2; and at least 15% of the pieces have a maximum elevated tier of a second elevated tier or visible tier 3.

11. The tier-on-tier multiple level jigsaw puzzle of claim 1, wherein the plurality of single tier puzzle pieces of the base puzzle and the plurality of single tier puzzle pieces of the upper puzzle comprise at least 20% of the pieces;

wherein the at least one multiple tier puzzle piece are bi-level pieces, and the bi-level pieces comprise at least 35% of the pieces;

wherein the at least one multiple level puzzle piece are tri-level pieces, and the tri-level pieces comprise at least 5% of the pieces.

12. The tier-on-tier multiple level jigsaw puzzle of claim 1, wherein the plurality of single tier puzzle pieces of the base puzzle and the plurality of single tier puzzle pieces of the upper puzzle further comprise at least 35% of the pieces.

13. The tier-on-tier multiple level jigsaw puzzle of claim 1, wherein the at least one multiple tier puzzle piece is a plurality of puzzle pieces and the at least one multiple tier puzzle pieces comprise the following:

at least 25% of the pieces have one change in tier elevation; and at least 12% of the pieces have two changes in tier elevation.

14. The tier-on-tier multiple level jigsaw puzzle of claim 13, wherein the at least one multiple tier puzzle pieces further comprise at least 8% of the pieces have three changes in tier elevation.

15. The tier-on-tier multiple level jigsaw puzzle of claim 1, wherein the top face of at least one of the plurality of single tier puzzle pieces in the upper puzzle has a contour or a contoured texture, wherein the contour or contoured texture mimics a subject object.

16. The tier-on-tier multiple level jigsaw puzzle of claim 1, wherein the top face of at least one multiple tier puzzle piece has a contoured texture, wherein the contoured texture mimics a subject object.

17. The tier-on-tier multiple level jigsaw puzzle of claim 1, wherein the puzzle has a straight border, jigsaw border, or a contoured border.

18. The tier-on-tier multiple level jigsaw puzzle of claim 1, wherein the tier-on-tier multiple level jigsaw puzzle further comprise the following:

the plurality of upper puzzle pieces comprise a minimum of 25% of the total number of plurality of puzzle pieces.

19. The tier-on-tier multiple level jigsaw puzzle of claim 1, wherein top face of at least one of the plurality of single tier puzzle pieces and at least one multiple tier puzzle piece has a texture, therein the texture is smocking, velour, velvet, felt, artificial fur, flocking, plush, glitter, foil, vinyl leather-texture material, vinyl wood-texture material, sand, or combinations thereof.

* * * * *